US011686191B2

(12) United States Patent
Rodney et al.

(10) Patent No.: US 11,686,191 B2
(45) Date of Patent: Jun. 27, 2023

(54) IDENTIFICATION OF RESIDUAL GRAVITATIONAL SIGNAL FROM DRILLING TOOL SENSOR DATA

(71) Applicant: HALLIBURTON ENERGY SERVICES, INC., Houston, TX (US)

(72) Inventors: Paul F. Rodney, Spring, TX (US); Reena Agarwal Chanpura, Sugar Land, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 462 days.

(21) Appl. No.: 17/072,563

(22) Filed: Oct. 16, 2020

(65) Prior Publication Data

US 2022/0120171 A1 Apr. 21, 2022

(51) Int. Cl.
*E21B 47/024* (2006.01)
*E21B 7/04* (2006.01)

(52) U.S. Cl.
CPC ..... *E21B 47/024* (2013.01); *E21B 7/04* (2013.01)

(58) Field of Classification Search
CPC ..... E21B 47/024
USPC ..... 33/302, 304, 310
See application file for complete search history.

(56) References Cited

U.S. PATENT DOCUMENTS 5,739,431 A * 4/1998 Petri ..... G01R 33/028 73/152.59
6,179,067 B1 1/2001 Brooks
9,932,820 B2 * 4/2018 Sugiura ..... G01C 17/38
10,202,841 B2 * 2/2019 Zhang ..... E21B 47/07
10,227,867 B2 * 3/2019 Chau ..... E21B 7/046
10,309,215 B2 * 6/2019 Bittar ..... E21B 47/13
10,550,682 B2 * 2/2020 Erdos ..... E21B 44/00
10,605,066 B2 * 3/2020 Peter ..... E21B 47/024
10,858,929 B2 * 12/2020 Estes ..... E21B 47/024
10,890,062 B2 * 1/2021 Rodney ..... E21B 44/00
11,180,984 B2 * 11/2021 Dirksen ..... E21B 7/10
11,299,981 B2 * 4/2022 Nguyen ..... E21B 47/022
(Continued)

FOREIGN PATENT DOCUMENTS

EP 3143246 B1 5/2019
GB 2535525 A 8/2016
(Continued)

OTHER PUBLICATIONS

International Search Report and Written Opinion, PCT Application No. PCT/US2020/062731, dated Jul. 5, 2021.
(Continued)

*Primary Examiner* — George B Bennett
(74) *Attorney, Agent, or Firm* — Novak Druce Carroll LLP

(57) ABSTRACT

In some aspects, the disclosed technology provides solutions for computing a residual noise signal from received gravitational field signal data. In one aspect, a process of the disclosed technology includes steps for receiving a magnetic field signal, wherein the magnetic field signal is generated by measurements produced by a magnetometer disposed in a drilling tool chassis, receiving a gravitational field signal, and processing the magnetic field signal to generate a clean magnetic field signal. In some aspects, the process can further include steps for calculating a residual signal based on the clean magnetic field signal and the gravitational field signal. Systems and machine-readable media are also provided.

20 Claims, 12 Drawing Sheets

(56) References Cited

U.S. PATENT DOCUMENTS

| | | | | |
|---|---|---|---|---|
| 11,340,378 | B2 * | 5/2022 | Galford | E21B 7/04 |
| 11,454,107 | B2 * | 9/2022 | Lloyd | E21B 47/0228 |
| 11,598,152 | B2 * | 3/2023 | Ghimire | E21B 47/09 |
| 2004/0222019 | A1 | 11/2004 | Estes et al. | |
| 2018/0045850 | A1 | 2/2018 | Smidth et al. | |
| 2018/0223646 | A1 | 8/2018 | Zhang et al. | |
| 2018/0266239 | A1 * | 9/2018 | Jarrot | E21B 47/092 |
| 2020/0072038 | A1 * | 3/2020 | Weston | E21B 47/022 |
| 2020/0355065 | A1 * | 11/2020 | Sankaran | E21B 47/024 |
| 2022/0120169 | A1 * | 4/2022 | Rodney | E21B 7/04 |
| 2022/0243580 | A1 * | 8/2022 | Zhang | E21B 44/04 |

FOREIGN PATENT DOCUMENTS

| | | | |
|---|---|---|---|
| WO | 021-03394 | A2 | 12/2002 |
| WO | 2016043723 | A1 | 3/2016 |

OTHER PUBLICATIONS

Search Report; GB Application No. 2113114.9; dated Jan. 28, 2022.

* cited by examiner

IDENTIFICATION OF RESIDUAL GRAVITATIONAL SIGNAL FROM DRILLING TOOL SENSOR DATA

TECHNICAL FIELD

The present disclosure pertains to downhole sensors and in particular, to systems and methods for identifying residual signal information generated by one or more gravitational sensors.

BACKGROUND

Various tools and tool systems have been developed to facilitate the exploration and production of hydrocarbon wells. In such applications, boreholes are frequently drilled toward a particular target, and thus it is necessary to repeatedly determine the drill bit's position or orientation within the borehole. Drill bit positions are typically ascertained by placing an array of gravitational sensors (e.g., accelerometers and/or gyroscopic sensors) and magnetic sensors (e.g., magnetometers) near the bit, which measure the earth's gravitational and magnetic fields. Magnetometers help detect the azimuth of the drilling tools near the drill bit. The inclination of the drilling tool can be determined using accelerometers. In typical operation, outputs of these sensors are conveyed to the earth's surface and processed by a drilling operator. However, in some implementations, preliminary calculations can be made down hole, for example, to reduce the telemetry bandwidth used during the drilling process. Using successive measurements made as the borehole is drilled, the bit's "present position" (PP) in three-dimensions can be determined and used to facilitate directional drilling.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
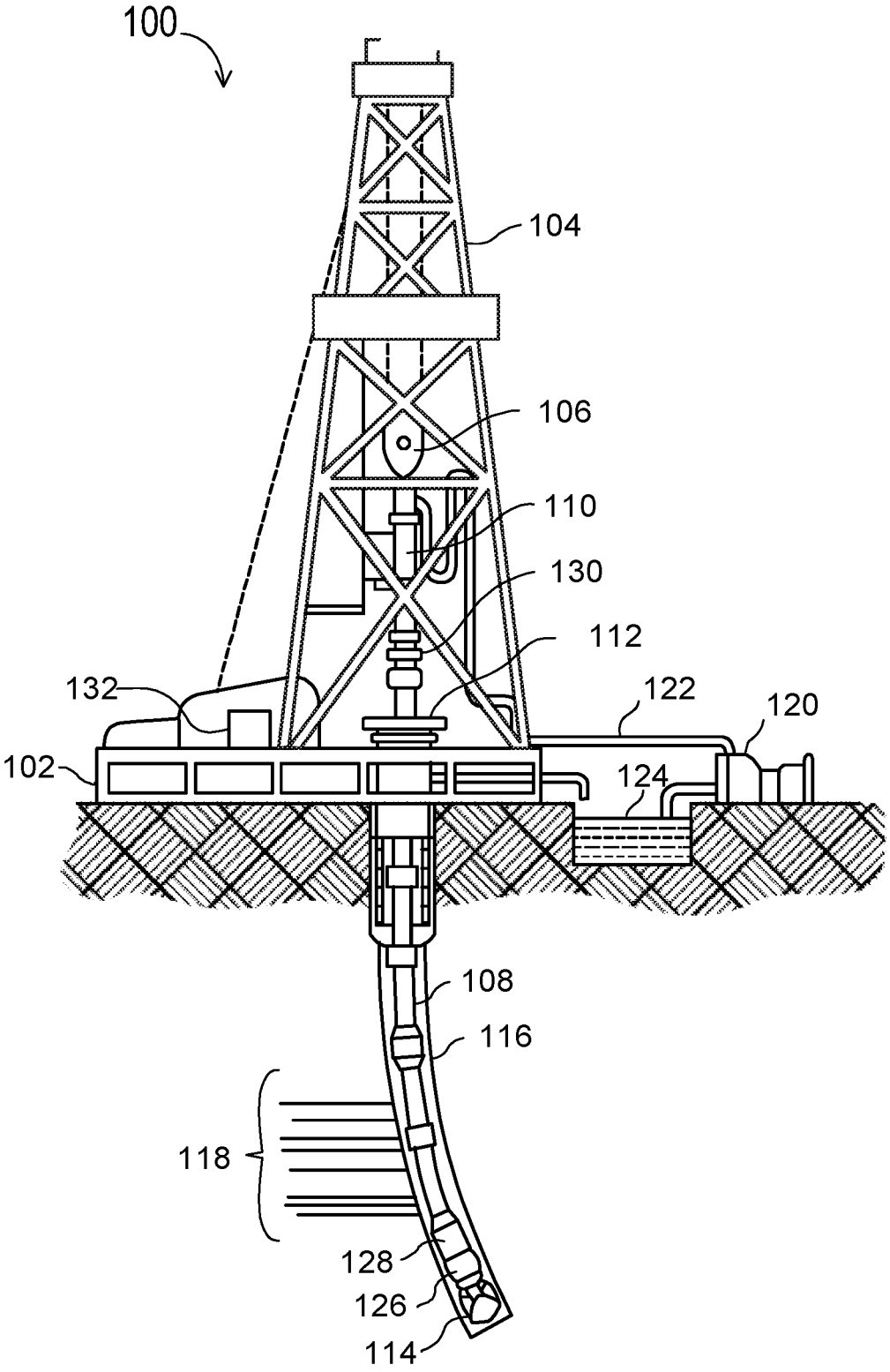
FIG. 1A is a schematic diagram of an example drilling environment.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a more thorough understanding of the subject technology. However, it will be clear and apparent that the subject technology is not limited to the specific details set forth herein and may be practiced without these details. In some instances, structures and components are shown in block diagram form in order to avoid obscuring the concepts of the subject technology.

Downhole directional sensors typically include one or more sensor types. For example, magnetic sensors can be used for measuring the earth's magnetic field, gravitational sensors (e.g., accelerometers), can be used for measuring the earth's gravitational field, and/or gyroscopic sensors can be used to discern a relative direction of the axis of the Earth's rotation. In some approaches, the magnetic sensor may have up to three magnetometers for respectively performing x, y, and z-axis measurements of the earth's magnetic field. The earth's magnetic field is substantially constant for short durations at any given point, so the objective is to measure the local constant component of the field (B field) in each of the (up to) three orthogonal axes. Even under typical drilling conditions, the orientations of reference frames for the gravitational field sensors, and/or gyroscopic sensors can differ from those of magnetic field measurements by a (substantially) constant offset when the tool is not subject to motion (vibration) or magnetic interference. When surveys are conducted in a static environment, the magnetic measurements are typically more noisy than the gravitational measurements. However, in a dynamic environment, gravitational field measurements often contain more noise and, for example, can include noise generated by vibrations or wobbling in the bit, or due to other types of drilling or formation anomalies.

Because signal noise components in the gravitational field measurements result from changes in tool motion/rotation, it would be advantageous to extract and analyze the noise to better understand the state of drilling operations and the drilling environment. For example, it would be advantageous to use the gravitational field signals for help in inferring system operations, bit performance, and/or formation properties, etc.

Aspects of the disclosed technology address the foregoing need by providing systems and methods for extracting noise from gravitational field measurements using magnetic field signal data, and for producing a residual signal that contains information about drill bit motion anomalies. In some aspects, the residual signal (also residual signal data) can be used to make inferences regarding drilling operation performance, and/or wellbore properties, and can therefore be used to improve real-time drilling operations. In other aspects, drilling operation data can be used to extract/generate residual signal data that can be used to perform anomaly detection, for example, by training a machine-learning classifier, and performing drilling anomaly detection using a trained machine-learning model.

Figure 1B:
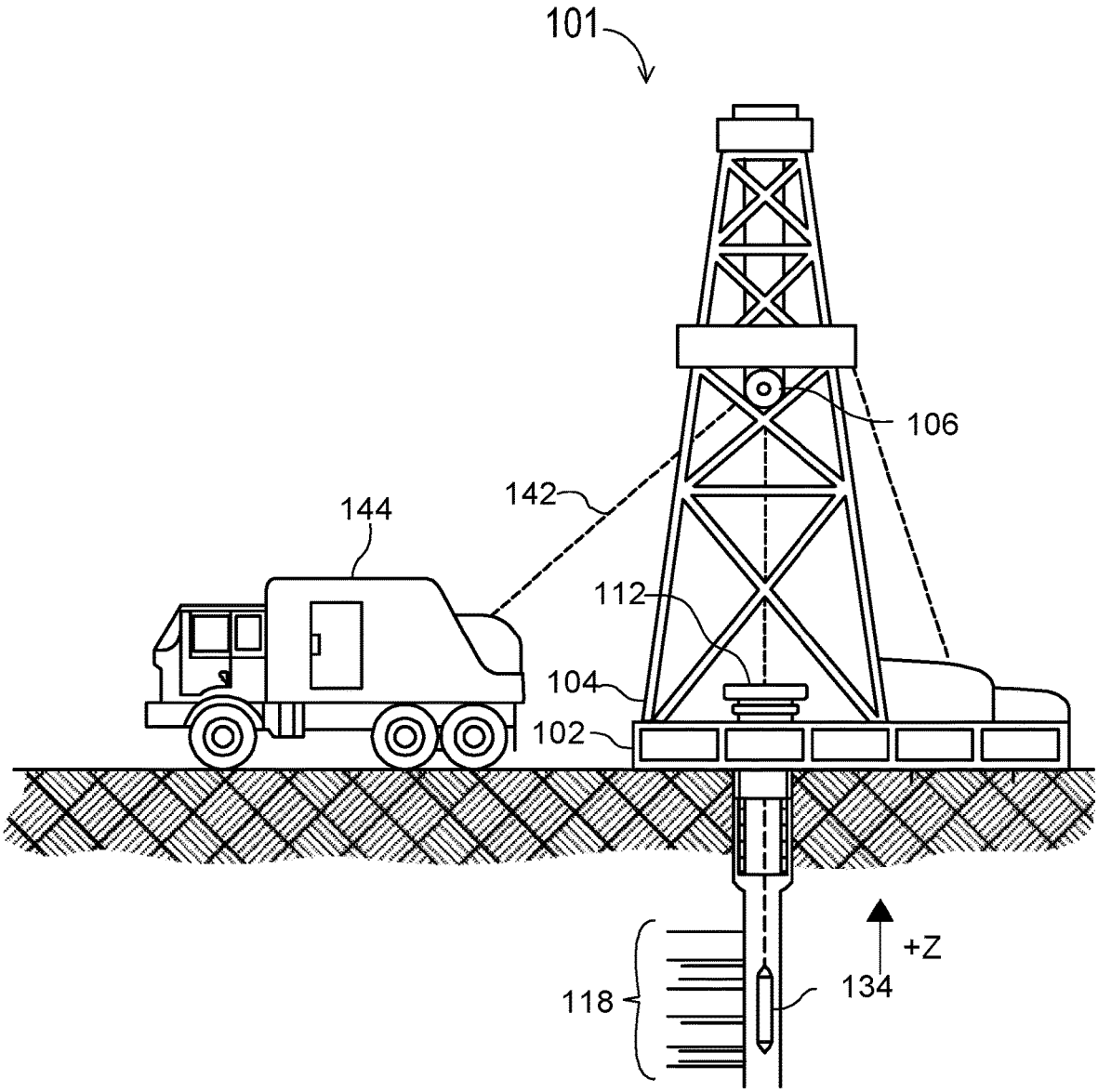
FIG. 1B is a schematic diagram of an example wireline logging environment.

The disclosure now turns to FIGS. 1A-B, and FIG. 2 to provide a brief introductory description of the larger systems that can be employed to practice the concepts, methods, and techniques disclosed herein. A more detailed description of the methods and systems for implementing the improved semblance processing techniques of the disclosed technology will then follow.

FIG. 1A shows an illustrative drilling environment 100. As illustrated, drilling platform 102 supports derrick 104 having traveling block 106 for raising and lowering drill string 108. Kelly 110 supports drill string 108 as it is lowered through rotary table 112. Drill bit 114 is driven by a downhole motor and/or rotation of drill string 108. As bit 114 rotates, it creates a borehole 116 that passes through various formations 118. Pump 120 circulates drilling fluid through a feed pipe 122 to kelly 110, downhole through the interior of drill string 108, through orifices in drill bit 114, back to the surface via the annulus around drill string 108, and into retention pit 124. The drilling fluid transports cuttings from the borehole into pit 124 and aids in maintaining borehole integrity.

Downhole tool 126 can take the form of a drill collar (i.e., a thick-walled tubular that provides weight and rigidity to aid the drilling process) or other arrangements known in the art. Further, downhole tool 126 can include various sensor and/or telemetry devices, including but not limited to: acoustic (e.g., sonic, ultrasonic, etc.) logging tools and/or one or more magnetic directional sensors (e.g., magnetometers, etc.). In this fashion, as bit 114 extends the borehole through formations 118, the bottom-hole assembly (e.g., directional systems, and acoustic logging tools) can collect various types of logging data. For example, acoustic logging tools can include transmitters (e.g., monopole, dipole, quadrupole, etc.) to generate and transmit acoustic signals/waves into the borehole environment. These acoustic signals subsequently propagate in and along the borehole and surrounding formation and create acoustic signal responses or waveforms, which are received/recorded by evenly spaced receivers. These receivers may be arranged in an array and may be evenly spaced apart to facilitate capturing and processing acoustic response signals at specific intervals. The acoustic response signals are further analyzed to determine borehole and adjacent formation properties and/or characteristics.

For purposes of communication, a downhole telemetry sub 128 can be included in the bottom-hole assembly to transfer measurement data to surface receiver 130 and to receive commands from the surface. In some implementations, mud pulse telemetry may be used for transferring tool measurements to surface receivers and receiving commands from the surface; however, other telemetry techniques can also be used, without departing from the scope of the disclosed technology. In some embodiments, telemetry sub 128 can store logging data for later retrieval at the surface when the logging assembly is recovered.

At the surface, surface receiver 130 can receive the uplink signal from downhole telemetry sub 128 and can communicate the signal to data acquisition module 132. Module 132 can include one or more processors, non-transitory storage media, input devices, output devices, software, and the like as described in further detail below. Module 132 can collect, store, and/or process the data received from tool 126 as described herein.

At various times during the drilling process, drill string 108 may be removed from the borehole as shown in example environment 101, illustrated in FIG. 1B. Once drill string 108 has been removed, logging operations can be conducted using a downhole tool 134 (i.e., a sensing instrument sonde) suspended by a conveyance 142. In one or more embodiments, the conveyance 142 can be a cable having conductors for transporting power to the tool and telemetry from the tool to the surface. Downhole tool 134 may have pads and/or centralizing springs to maintain the tool near the central axis of the borehole or to bias the tool towards the borehole wall as the tool is moved downhole or uphole.

Downhole tool 134 can include various directional and/or acoustic logging instruments that collect data within borehole 116. A logging facility 144 includes a computer system, such as those described with reference to FIG. 6, discussed below, for collecting, storing, and/or processing the measurements gathered by logging tool 134. In one or more embodiments, the conveyance 142 of downhole tool 134 can be at least one of wires, conductive or non-conductive cable (e.g., slickline, etc.), as well as tubular conveyances, such as coiled tubing, pipe string, or downhole tractor. Downhole tool 134 can have a local power supply, such as batteries, downhole generator and the like. When employing non-conductive cable, coiled tubing, pipe string, or downhole tractor, communication can be supported using, for example, wireless protocols (e.g. EM, acoustic, etc.), and/or measurements and logging data may be stored in local memory for subsequent retrieval.

Although FIGS. 1A and 1B depict specific borehole configurations, it is understood that the present disclosure is equally well suited for use in wellbores having other orientations including vertical wellbores, horizontal wellbores, slanted wellbores, multilateral wellbores and the like. While FIGS. 1A and 1B depict an onshore operation, it should also be understood that the present disclosure is equally well suited for use in offshore operations. Moreover, the present disclosure is not limited to the environments depicted in FIGS. 1A and 1B, and can also be used in either logging-while drilling (LWD) or measurement while drilling (MWD) operations.

Figure 2A:
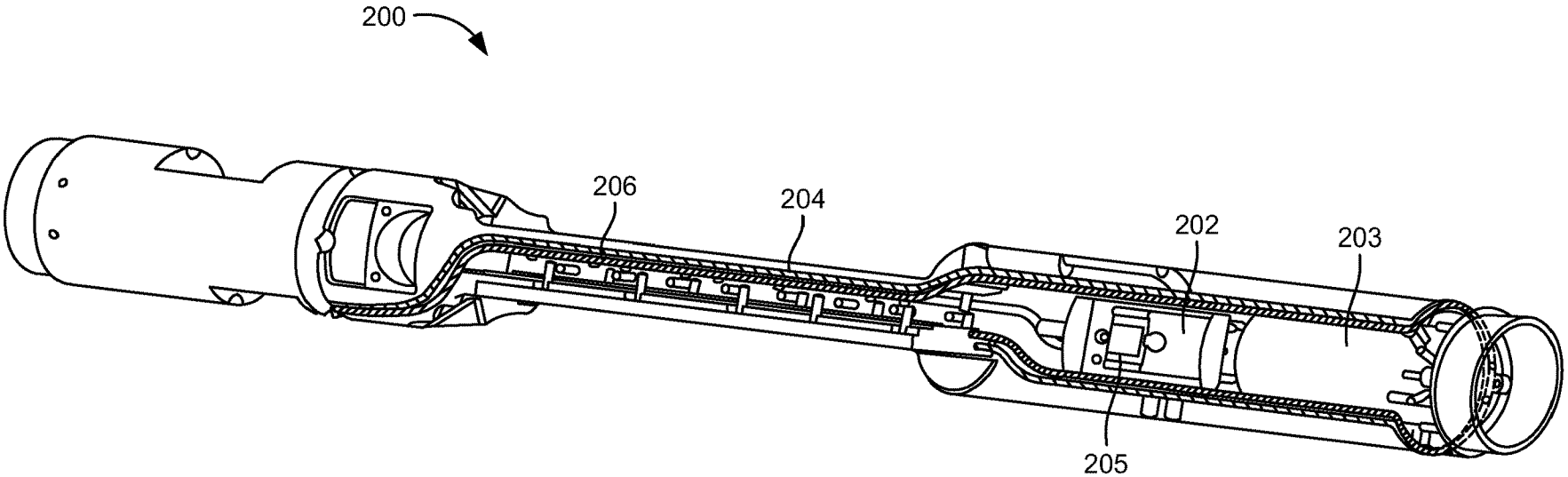
FIG. 2A is a perspective view of a downhole tool that includes a directional module including at least one magnetometer and at least one gravitational sensor, according to some aspects of the disclosed technology.

FIG. 2A is a perspective view of a downhole module 200 that includes various directional sensors, e.g., magnetometer 202, and gravitational sensors 205. It is understood that additional magnetometers and various types of gravitational sensors (e.g., accelerometers and/or gyroscopic sensors) may be used, without departing from the scope of the disclosed technology. In the illustrated configuration, the directional sensors (magnetometer 202, gravitational sensors 205) are enclosed in a chassis 203. Downhole module 200 is concentrically retained within a drill collar of the downhole tool (not shown). In some implementations, chassis 203 can provide an electrical ground for one or more power supplies used to power various sensors and systems within downhole module 200 (not shown). Downhole module 200 also includes two power rails (204, 206), that are configured to provide power from one or more power supplies (e.g., batteries) to one or more module/s and/or sensor/s within or adjacent to downhole module 200. Although the illustrated example provides two power rails, it is understood that a greater (or fewer) number can be implemented in downhole tool 200, without departing from the scope of the disclosed technology. In some alternative configurations, batteries may be disposed in close proximity to the sensors, for example, to mitigate magnetic fields from stray currents.

In operation, multiple orientation signals (e.g., a first orientation signal and a second orientations signal) can be generated from data collected by the various sensors to determine tool orientation. For example, magnetic field measurements from the magnetometers 202 can be used to produce a first orientation signal, and gravitational field measurements (e.g., from accelerometers 205) can be used to generate a second orientation signal. Together, the first orientation signal and the second orientation signal can be used to infer tool orientation, such as inclination (tool face), and azimuth. Although conventions for tool face can vary depending on the application, as used herein, the tool face angle from a pair of X, Y sensors can be calculated as ArcTan2(SensorY, −SensorX), wherein ArcTan2 is a four quadrant Arctangent function, where the X and Y sensors are orthogonal to each other, and orthogonal to the tool axis (that is, the Z axis). In some approaches, magnetic field values will be designated as BX or BY (depending on whether the sensors are aligned with the tool's X- or Y-axes), while the accelerometer outputs can be designated as GX, GY and GZ.

In some implementations, magnetic field measurements (BX, BY) and gravitational field measurements (GX, GY, and GZ) are sampled more-or-less simultaneously (e.g., every a few ms). Depending on the implementation, one or more gravitational field measurements may not be needed. For example, measurement of GZ may be optional. In some approaches, the magnetic/gravitational field sampling is performed at a continuous rate, however, in some implementations, sampling may occur at non-periodic time intervals. Each set of samples can correspond to a unique sample number, i and can be labeled based on the sample; however, the sampling numbers need not refer to monotonically increasing values of time or to equal time interval. As used herein, samples may belong to the set of individual values taken at an instant labeled "i", $\{BX_i, BY_i, GX_i, GY_i, GZ_i\}$, or it may refer to a single value from a single sensor, such as $GX_i$.

As discussed in further detail below with respect to FIG. 3A, magnetic field signals and gravitational field signals resulting from the magnetometer/gravitational sensor measurements can be used to generate a residual signal. The residual signal contains useful information about drill bit/tool movement and operation. By way of example, in some implementations, the residual signal may be used to infer patterns of motion or tool displacement that indicate anomalies relating to drilling equipment and/or operations, and/or that indicate changes to formation characteristics, such as changes to the wellbore diameter.

Figure 2B:
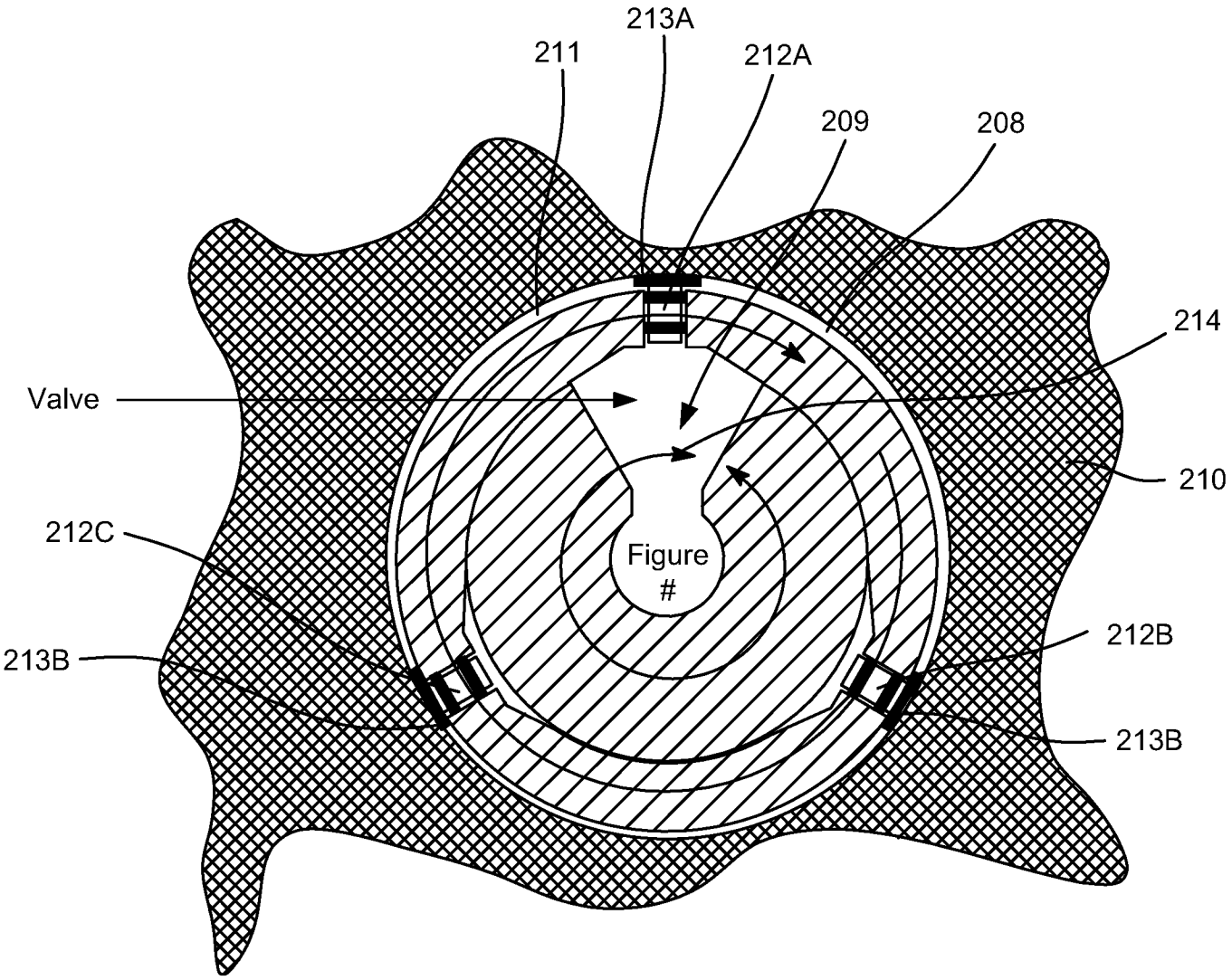
FIG. 2B illustrates a cut-away view of an example cylindrical central unit portion rotary steerable tool, according to some aspects of the disclosed technology.

The disclosure now turns to FIG. 2B, which illustrates a cut-away view of an example cylindrical central unit 208 portion of a rotary steerable tool, according to some aspects of the disclosed technology. In the illustrated example, central unit is deployed in borehole 116, and is configured such that the cylindrical central unit 208 has a valve 214 that opens up into a coaxial cylinder 211 that is free to rotate about the central unit, typically as a part of the drillstring. Valve 214 opens up into the outer cylinder via a funnel-like aperture 209. In this example, three pistons 212 (e.g., 212A, 212B, and 212C) are symmetrically mounted in holes through the outer cylinder, wherein each of pistons 212 are coupled to, and configured to actuate, a corresponding pad 213 (e.g., 213A, 231B, and 231C, respectively). The outer end of each piston 212 is connected to a corresponding pad 213 that, when the piston is actuated, can sometimes press against (or toward) the adjacent section of formation 210. In some aspects, the inner end of each cylinder (optionally) opens up into a funnel-like aperture similar to 209. To drill in a specific direction, central unit 208 can be constrained so that the opening in valve 214 points away from a direction in which it is desired to steer the unit. In operation, fluid pumped through valve 214 activates the adjacent piston, causing the adjoining pad to push against an adjacent portion of formation 210, hence pushing the drillstring in the opposite direction. In the example shown, as the drillstring rotates, the three valves are activated cyclically when steering in a fixed direction. The funnel shape at the exit of valve 214 and entrance to each of the pistons makes it possible to apply pressure on a piston for a significant portion of each rotation of the drillstring. Depending on funnel size, it is possible that only one pad is activated at a time, but with sufficiently wide funnels, it is possible, during portions of a rotation to activate two pads.

With a three-pad system, it is expected that the force on the tool, and hence the cross-axial accelerations that are in addition to gravitational acceleration (i.e. the residual cross-axial accelerations) tend to exhibit a three-lobed residual signal pattern if the tool is operating properly.

Because of the synchrony of the pads with the rotation of the tool when the tool is steered with the valve at a fixed tool face angle, it can be desirable to process the signals from all of the accelerometers (including the tool-axis accelerometer) by binning the measured values into bins corresponding to fixed ranges of tool face angle. Whereas the tool face angle used to control the valve is typically a gravitational tool face value (but it need not be), the tool face values used in binning are more typically obtained using magnetic tool face values. This is done because the magnetic signals are generally fairly clean and it is normally reasonably easy to filter out any noise from the magnetic measurements that may arrive e.g. from current transients through the system.

Figure 3A:
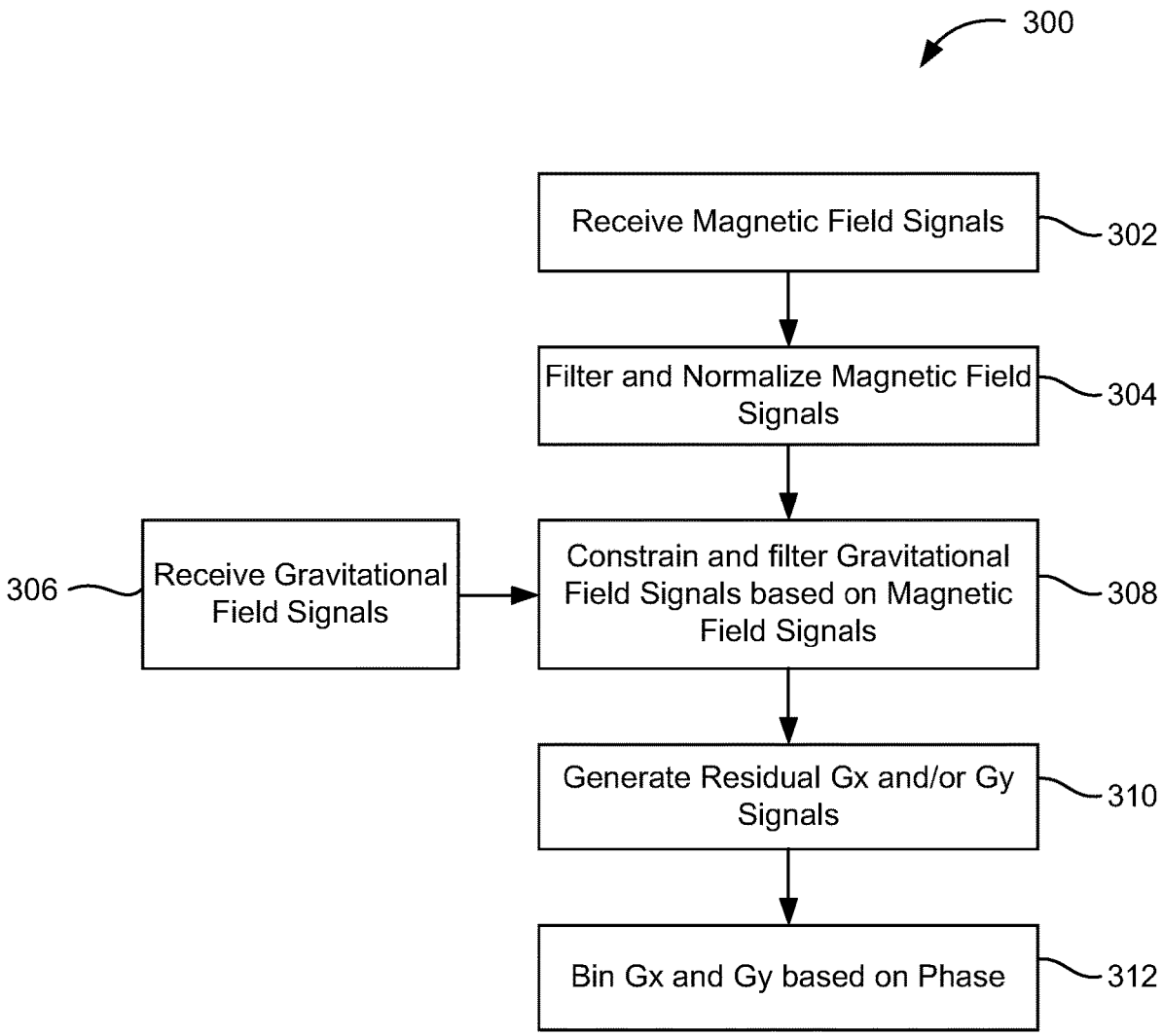
FIG. 3A is a schematic diagram of an example approach to determining a residual signal from magnetic and gravitational field signals, according to some aspects of the disclosed technology.

FIG. 3A is a schematic diagram 300 of an example system for generating a residual signal from magnetic and gravitational field signals, according to some aspects of the disclosed technology. Initially, magnetic field signals are received (302), e.g., from magnetic field measurements taken by a magnetometer. In some approaches, X and Y coordinate measurements (e.g., $BX_i$, $BY_i$ measurements) are recorded (e.g., as cross-axial magnetic field measurements), however, in other implementations, only magnetic field measurements from one cross-axial dimension may be received.

In some aspects, pre-processing can be performed on the received magnetic field signals (304), for example, to filter and/or normalize the samples to remove (for example) high-frequency components resulting from currents within the rotary tool (e.g., using a low-pass filter). Filtering can be performed based on currently known tool parameters, or noise (e.g., due to-interfering tool currents) may be reduced by other calibration procedures. By way of example, BX and BY signal filtering can be performed using a filter cutoff frequency that produces little or no distortion in B field readings as rotary speeds change. Depending on the desired implementation, zero-delay filters, or digital filters with a constant (or near constant) delay over the expected range of rotational speeds may be used. Subsequently, the filtered BX and BY signals can be normalized to a common, constant amplitude.

In some aspects, B signal normalization can be performed by examining the minima and maxima of the BX, BY signals. In some approaches, B field normalization may be performed such that the amplitude of each signal is 1. Subsequently, phase information (i.e., magnetic tool face) can be calculated for each sample. As discussed in further detail below, the magnetic tool face values can be used for binning the resulting residual signal measurements.

Gravitational field signals (306) can be received, for example concurrently with (or substantially concurrently with), magnetic field signals (302). For example, gravitational field signals can be produced by accelerometer measurements ($GX_i$, $GY_i$); similar processing can be done with dynamic angular measurements made with gyroscopes. The gravitational field signal can be filtered and/or constrained, for example, by performing a constrained regression of GX and GY to BX and BY using a model in which GX and GY are orthogonal (to each other) and have the same amplitude. Subsequently, residual signals for GX (e.g., GXr) and GY (e.g., GYr) can be calculated based on the received magnetic and gravitational field signal/s (310). In some aspects, the residual signal can be based on the raw acceleration signal and the acceleration signal as filtered using the magnetic field signal, as discussed in further detail below.

Once the residual signal has been calculated/generated, binning can be performed, for example, to sort GXi, GYi signal measurement values into their respective tool-face angle positions (312). In some aspects, binning can be performed by first generating one or more arrays, such as four arrays (e.g., arrays of GXi, GYi) having bin widths of 360/L degrees, wherein 360/L can be larger than the expected angular resolution (in degrees) of the system. By way of example, if the signals are sampled at a constant rate (with a sample period Δt), and the maximum rotation frequency (max rpm) is known, then the largest value of L can be selected to be less than the value given by, equation (1):

$$L_{max} = \mathrm{Int}\left[\frac{60}{\max rpm * \Delta t}\right] \tag{1}$$

However, at maximum rpm, this would result in dropping all of the samples into only one bin. Therefore, in practice, the value selected for L can be selected to be less than $L_{max}$, for example, L can be a fractional value (e.g., 1/36 or 1/72) of $L_{max}$. However, other values for L are contemplated, without departing from the scope of the disclosed technology. A practical bound on L can be set by setting the sample rate, when possible such that there are at least 4 bins and such that the minimum expected time in a bin is at least 2× the sample period.

In equation (1), Int[x] designates the largest integer value that does not exceed X. For example, if x=72.9, Int[x]=72. Next, for each value of i, the tool face angle is calculated from $BX_i$ and $BY_i$. Tool face angle calculations can vary depending on the implementation, however, in some approaches, the tool face angle can be given by $MagTF_i = ArcTan2(BY_i, -BX_i)$ where ArcTan is the two argument arctangent function (the first argument being proportional to the sine of the associated angle; the second argument having the same proportionality, but to the cosine of the associated angle.) In some approaches, a single argument arctangent may be used. In this example, it is assumed that $BX_i$ and $BY_i$ are free (or relatively free) of magnetic interference, and represent the magnetic field that would be observed by a pair of orthogonal, properly calibrated magnetometers. As such, some signal processing may be applied to the raw magnetometer signals so as to obtain the data streams $BX_I$ and $BY_i$. Subsequently, a bin number is selected based on the magnetic tool face value. For example, calculate a bin number, where $BN_i = Int[MagTF_i/L]$. Next, add the value of $GX_i$ to bin $BN_i$ of the array set aside for binning GX. Similarly, bin the values of $GY_i$ and $GZ_i$, and add 1 to bin $BN_i$ of the fourth array, i.e. the array that is used to record how many times data were added to a particular bin. After the entire data set has been binned, it may be desirable to normalize the cumulative values in the bins. For example, this is especially helpful when comparing the results of successive binning runs. The normalization may consist simply of dividing by elapsed time, or the total number of samples, or by dividing each bin for each sensor by the number of entries in the corresponding bin number.

Figure 3B:
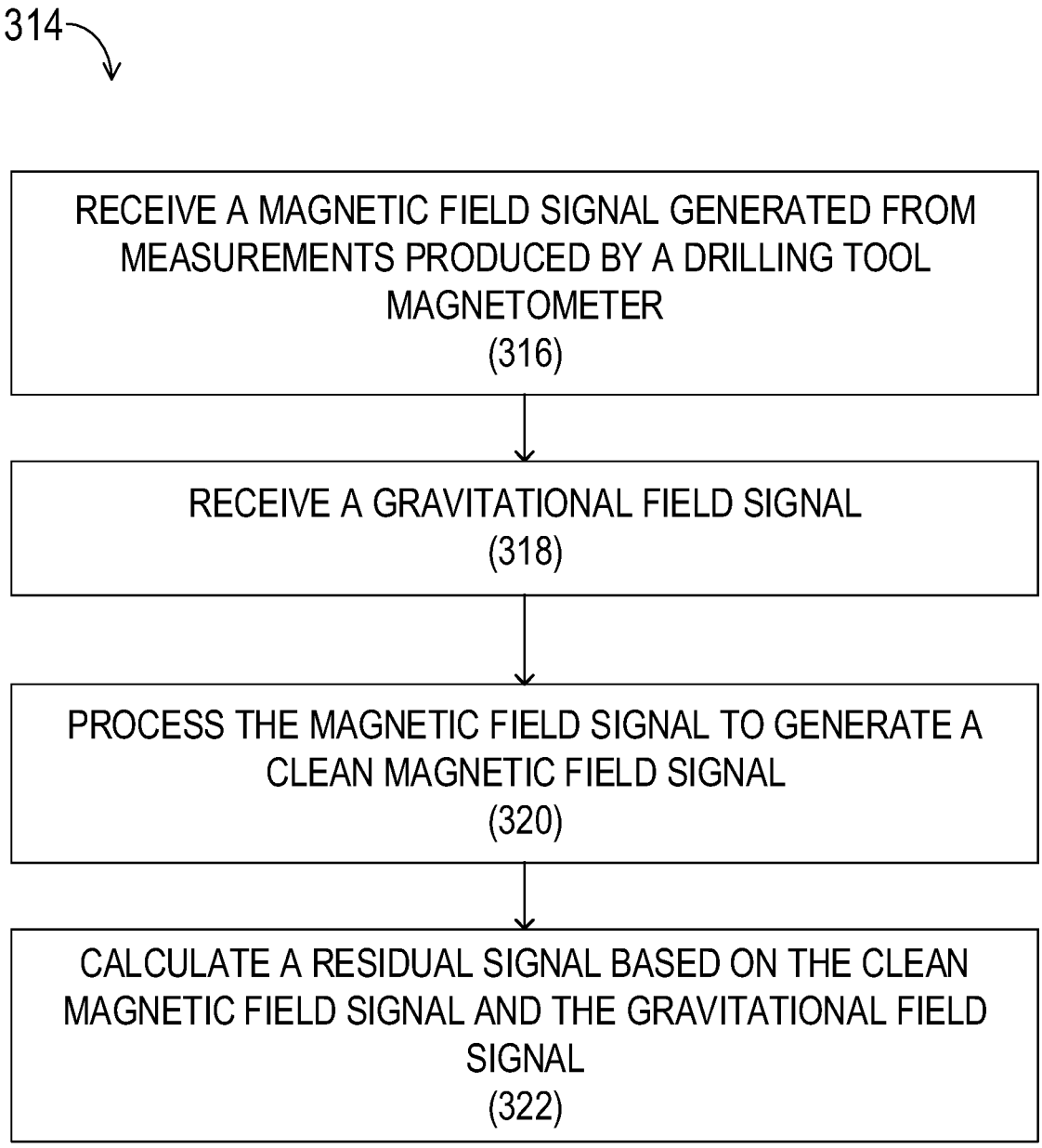
FIG. 3B illustrates steps of an example process for calculating a residual signal, according to some aspects of the disclosed technology.

FIG. 3B illustrates steps of an example process 314 for calculating a residual signal, according to some aspects of the disclosed technology. Process 314 begins with step 316 in which a magnetic field signal is received. As discussed above, the magnetic field signal can be generated from measurements (e.g., $BX_i$, $BY_i$) produced from a magnetic sensor, such as drilling tool magnetometer (e.g., see FIG. 2A).

In step 318, a gravitational (field) signal or alternatively a signal from a gyroscope sensing the rotation of the earth about the earth's axis is received. Similar to the magnetic field signal, the gravitational signal can be produced from measurements taken from sensors on a drilling tool. By way of example, the gravitational signal can be comprised of accelerometer measurements (e.g., $GX_i$, $GY_i$); alternatively, a signal based on measurements taken from one or more gyroscopic sensors may be used, for example, when using the vector aligned with the Earth's rotation as a reference.

In step 320, the magnetic field signal is processed to generate a clean magnetic field signal. As discussed with respect to FIG. 3A, the magnetic field signal may be filtered, for example, to remove high-frequency components that result from stray electromagnetic fields in the drilling tool. The magnetic field signal can also be normalized to a standard amplitude, for example, that is based on magnetic field signal maxima/minima. The resulting (clean) magnetic field signal (e.g., the filtered and normalized magnetic field signal) can represent an idealized signal representing, in part, non-noise components of tool orientation.

In step 322 a residual signal is calculated/generated based on the clean magnetic field signal and the received gravitational field signal. As discussed above, magnetic field signals can be used as references in a regression fit to the accelerometer signals. In some aspects, the magnetic field signals may be cleaned, and the accelerometer signals can also be pre-processed to perform filtering. As such, the filtered GX and GY signals are calculated using the regression. The residuals are the differences between the GX and GY signals that were inputs to the regression and the GX and GY signals that are modeled using the regression. As discussed in further detail below with respect to FIGS. 4A-4C, the residual signal can be analyzed to identify patterns (e.g., harmonics) that can represent forces on the tool that are due to causes other than changes in tool orientation, and which can indicate drilling equipment and/or wellbore anomalies, etc.

Figure 4A:
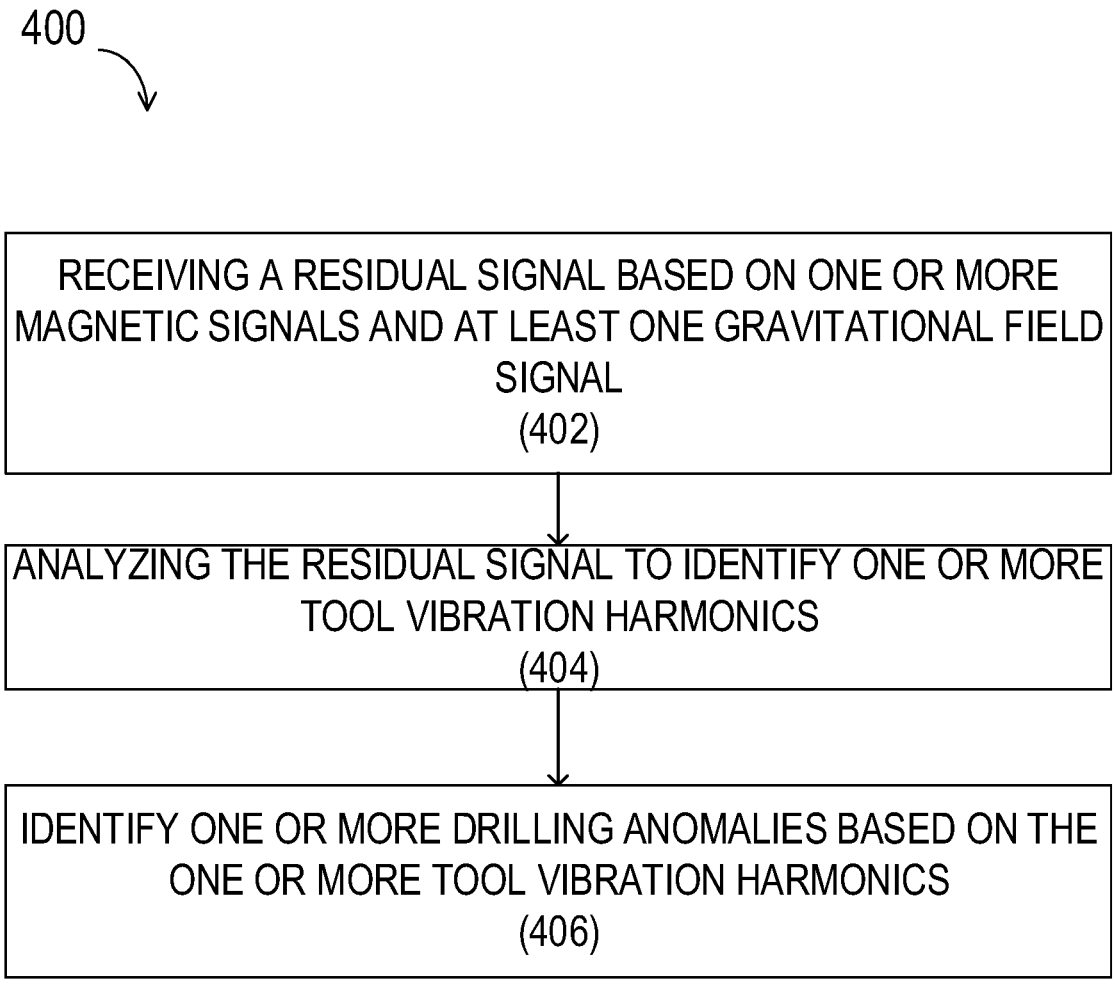
FIG. 4A illustrates steps of an example process for performing anomaly detection using a residual signal, according to some aspects of the disclosed technology.

FIG. 4A illustrates steps of an example process 400 for performing anomaly detection using a residual signal, according to some aspects of the disclosed technology. Process 400 begins with step 402 in which a residual signal is received. As discussed above, the residual signal is calculated/determined based on one or more magnetic signals and at least one gravitational field signal.

In step 404, the residual signal is analyzed to identify one or more tool vibration harmonics. As discussed in further detail below with respect to FIGS. 4B and 4C, vibration harmonics can occur in different patterns/frequencies based on the type of drilling anomaly. By way of example, failure of a single pad may produce a different harmonic pattern in the residual signal than would failure of two or more pads. As such, drilling anomalies may be identifiable based on the respective harmonics/patterns contained in the residual signal. By way of example, drilling anomalies may include drill bit wobble, for example, that results when the borehole is significantly larger than the drill bit. In such cases, the drill bit may orbit around the larger hole. Depending on the type of drill bit used and the condition of the bit, this may be in sync with the rotational speed or at a harmonic of the rotational speed. When drillstring orbiting occurs, a bend can develop in the drillstring such that a portion of the drillstring is always facing the borehole wall and typically interacting with it, e.g., by sliding. At certain rotational frequencies and load constraints, the orbit period of a bent drillstring may double or triple its rotational frequency, for example, indicating a potential approach toward a chaotic whirl condition.

In some implementations, detection of drilling anomalies can include the detection of a stick/slip condition, for example, in which the bit stops rotating while the drillstring is rotating and in which torque builds up in the drillstring, for example, resulting either in the bit breaking loose at a high counter-rotation rate and/or breakage of the drillstring. In yet other implementations, drilling anomaly detection can include the detection of degraded drill bit conditions. For example, if there is a defect in the drill bit, it will be reflected in the residual accelerations. The signature of the defect will depend on the type of bit and the nature of the defect.

Figure 4B:
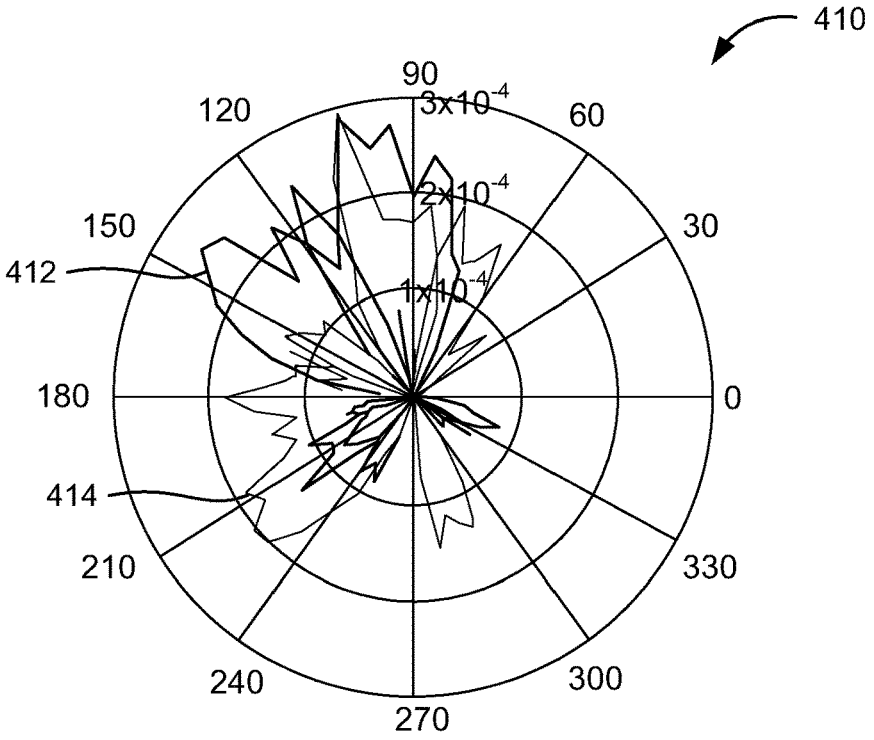
FIGS. 4B and 4C illustrates an example of a polar plot for binned residual signals, according to some aspects of the disclosed technology.
Figure 4C:
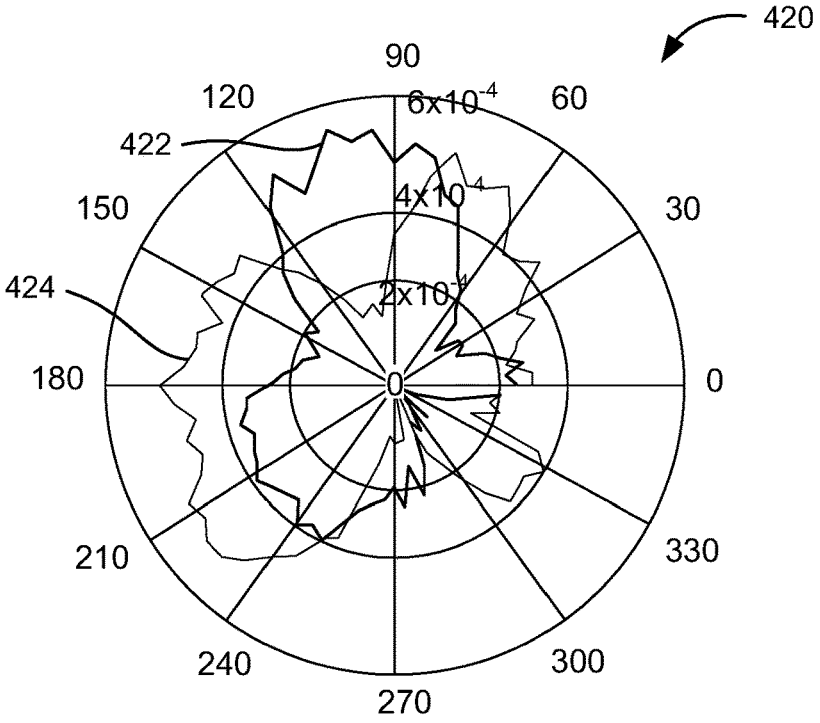

FIGS. 4B and 4C illustrates an example of a polar plot for binned residual signals, according to some aspects of the disclosed technology. In particular, in the polar plot of FIG. 4B, the binned values of GX and of GY are plotted vs. the angle corresponding to the bin numbers. This provides some indication of the angular position within the borehole of the interaction between the rotary steerable system and the borehole, but can be misleading in that bins with negative values are plotted with negative radii and thus appear 180° from the corresponding bin angle.

Figure 4D:
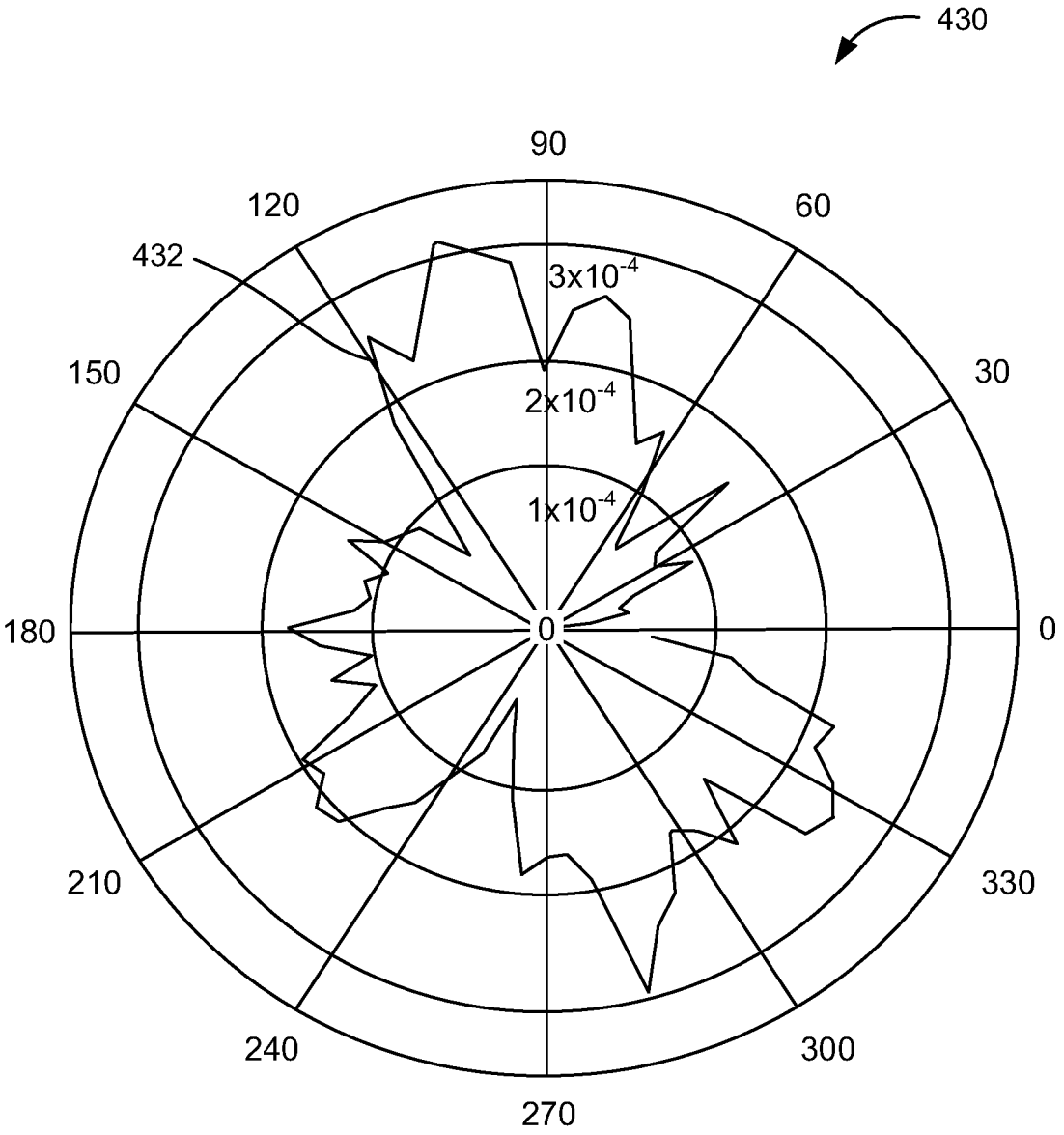
FIG. 4D illustrates an example of a polar plot of binned cross-axial residual signal values plotted against bin number (or bin angle), according to some aspects of the disclosed technology.

FIG. 4D illustrates an example of a polar plot of binned cross-axial residual signal values plotted against bin number (or bin angle), according to some aspects of the disclosed technology. In each of FIGS. 4B, 4C and 4D, the different magnitudes and widths of the lobes provide information about interaction between the pads and the formation. The smaller the magnitude of a lobe, the less interaction with the formation, and similarly for the width of the lobe. Further information is available when the magnitude of the cross-axial residual signals is calculated, as shown in the polar plot of FIG. 4D, which illustrates negative residuals plotted 180 degrees out of phase with their proper binning angle. In the example of FIG. 4D, a very clear three-lobed pattern is in evidence. In this case, the lobes are quite broad and roughly separated by 120°. Those of skill in the relevant art will understand that similar plots may be generated using other methods, for example, by binning absolute values of the residual signals, and/or offsetting the residual signals by the largest negative value of the binned signals.

Figure 5A:
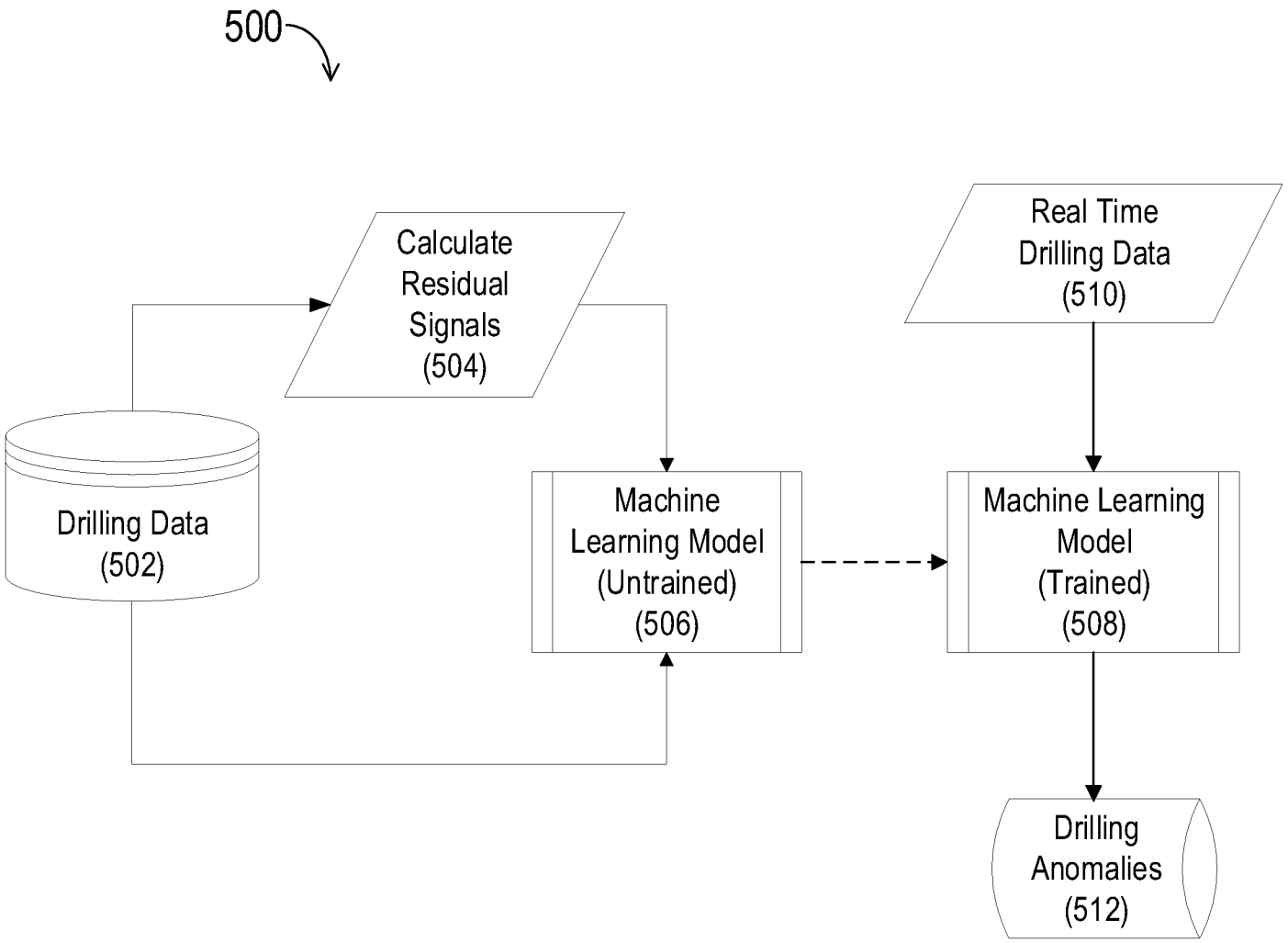
FIG. 5A illustrates a schematic block diagram of a system that can be implemented for training a machine-learning anomaly detection classifier, according to some aspects of the disclosed technology.

FIG. 5A illustrates a schematic block diagram of a system that can be implemented for training a machine-learning anomaly classifier, according to some aspects of the disclosed technology. System 500 includes a drilling data repository 502 that can represent one or more databases of stored (legacy) drilling data. In some aspects, drilling data repository 502 may represent two or more data sources, and can be virtually any type of memory device, or data repository capable of storing sensor data, for example, that is collected from one or more directional sensors of a drilling tool. Drilling data repository 502 can also include anomaly data (e.g., metadata) that indicates drilling equipment or operational anomalies, and which is correlated with the sensor data.

At block 504, one or more residual signals can be generated/computed, for example, from sensor data stored in drilling data repository 502, and then provided to a machine-learning model 506. In some aspects, machine-learning model 506 can represent an untrained anomaly classification model that is configured to correlate residual signal inputs with drilling anomalies, for example, that are also provided to machine-learning model 506. By training machine-learning model 506 on various residual signal/drilling anomaly example data sets, a trained machine-learning model 508 can be generated. In some approaches, the trained machine-learning model 508 can be used in real-time drilling operations, for example, to identify and/or classify operational anomalies, such as equipment failures and/or wellbore anomalies.

Further to the example illustrated with respect to FIG. 5A, the trained machine learning model 508 can be configured to receive real-time (or near real time) residual signal data 510, and to make predictions about current or upcoming anomalies to drilling operations. In some implementations, trained machine-learning model 508 may be used to automatically adjust one or more operational parameters, for example, to improve safety or efficiency of the drilling process.

Figure 5B:
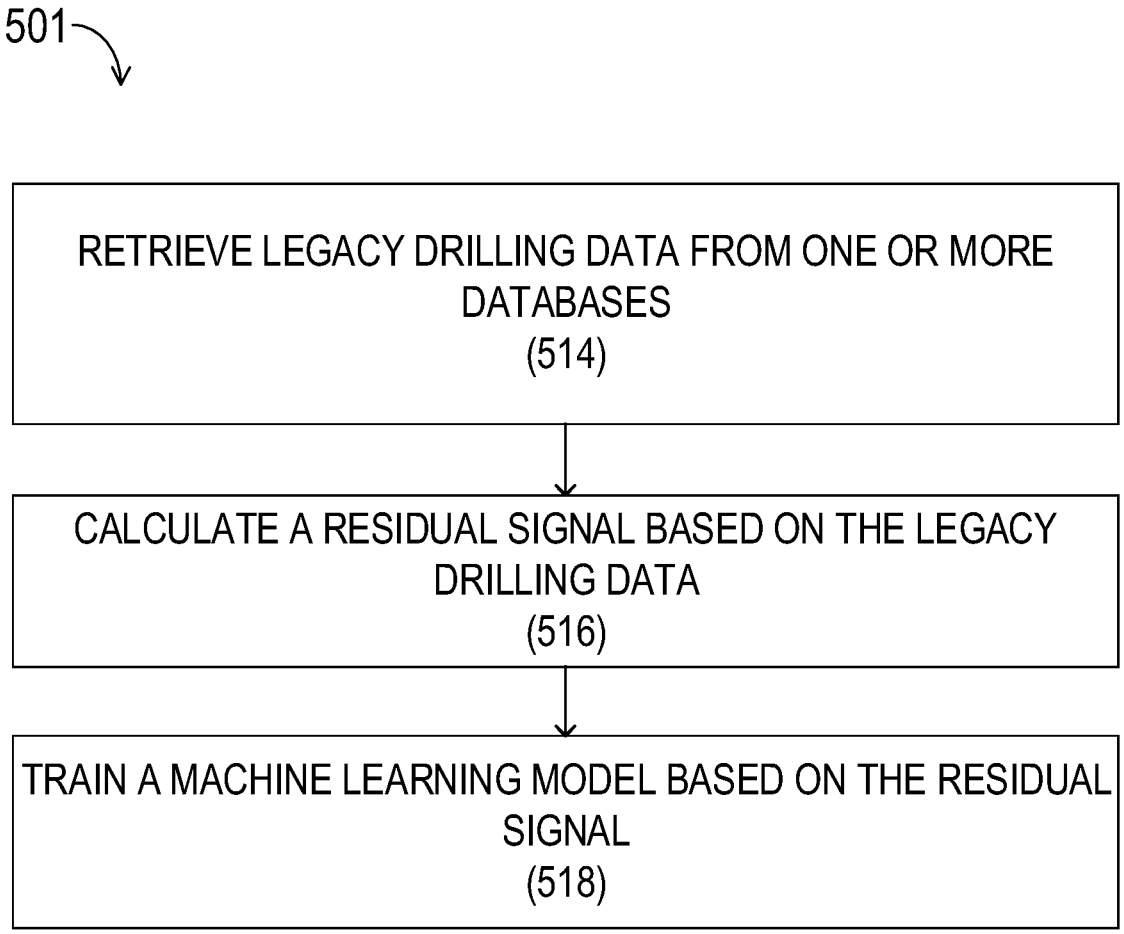
FIG. 5B illustrates steps of an example process for training a machine-learning based anomaly detection classifier, according to some aspects of the disclosed technology.

FIG. 5B illustrates steps of an example process 501 for producing a trained machine-learning anomaly classifier, according to some aspects of the disclosed technology. Process 501 begins with step 514 in which legacy drilling data is retrieved from one or more databases. As discussed above, legacy drilling data can include sensor signal data, including stored magnetic and gravitational field signals for one or more previous drilling operations. Additionally, the legacy drilling data can include anomaly data, indicating equipment failures or other encountered operational difficulties.

At step 516, residual signals can be calculated based on the legacy drilling data (e.g., based on the magnetic and gravitational field signal information). As discussed above, residual signal computations can be performed by pre-processing (filtering and/or normalizing) the magnetic field signal data, and using the cleaned magnetic field signal to remove the non-noisy signal components from the gravitational field signal. The resulting residual gravitational signal is then provided to the machine-learning model (518) together with the anomaly data. As such, the machine learning model can 'learn' to correlate detected anomalies with the corresponding residual signal information, i.e., computed from the gravitational and magnetic field sensor data at the associated time intervals.

Figure 6:
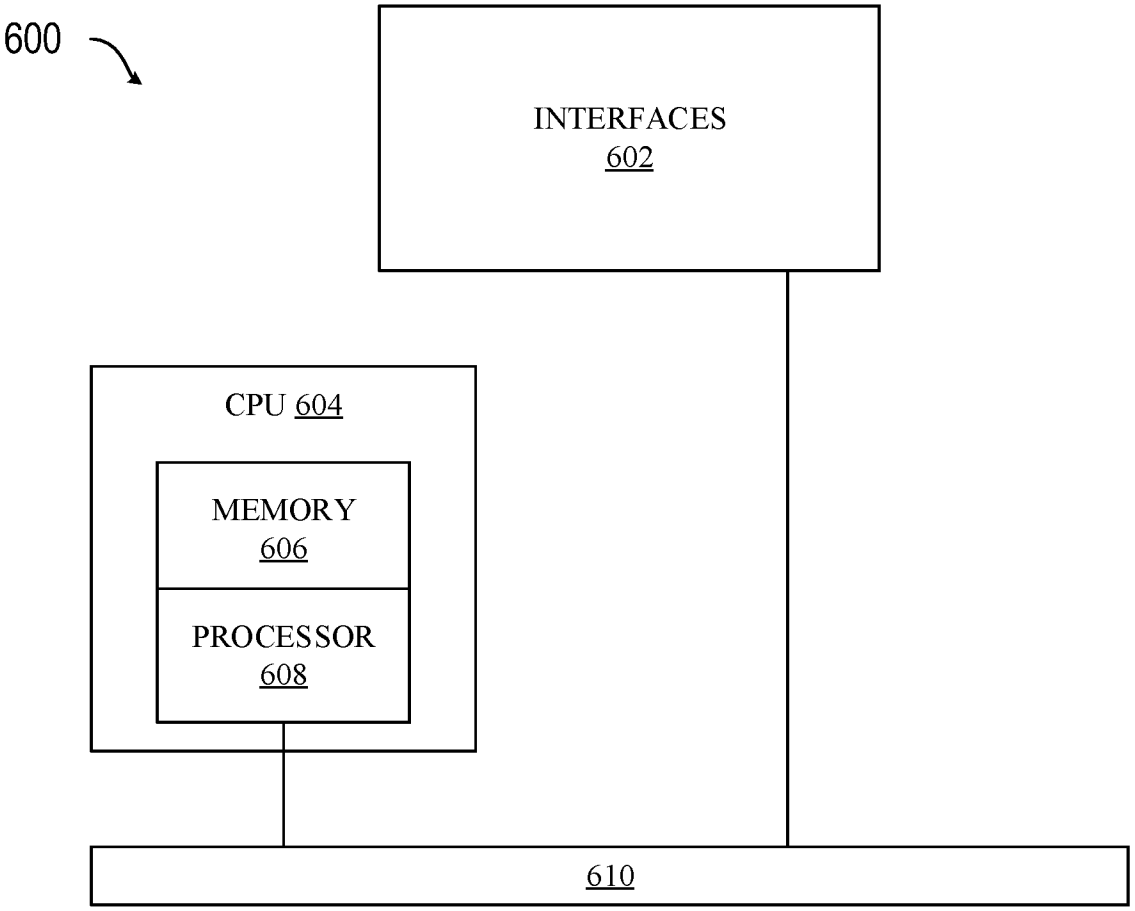
FIG. 6 is a schematic diagram of an example system embodiment.

FIG. 6 illustrates an example processing device 600 suitable for implementing a process of the disclosed technology. Device 600 includes interfaces 602, a central processing unit (CPU) 604, and a bus 610 (e.g., a PCI bus). When acting under the control of appropriate software and/or firmware controls, the CPU can execute instructions for performing any of processes 300, 314, 400 and/or 501, discussed above. CPU 604 can accomplish all these functions under the control of software and/or firmware including an operating system and any appropriate applications software. CPU 604 may include one or more processors 608, such as a processor from the INTEL X86 family of microprocessors. In some cases, processor 608 can be specially designed hardware for controlling various operations of a directional module, as discussed above. In some cases, a memory 606 (e.g., non-volatile RAM, ROM, etc.) also forms part of CPU 604. However, there are many different ways in which memory could be coupled to the system.

Interfaces 602 can be configured to acquire data and measurements from one or more computing and/or sensor systems, such as a magnetic sensor implemented in a directional module of the disclosed technology. In some cases, interfaces 602 may also include one or more additional independent processor(s) and, in some instances, separate on-board memory.

Although the system shown in FIG. 6 is one specific processing device of the present invention, it is by no means the only device architecture on which the present invention can be implemented. Further, other types of interfaces and media could also be used with processing device 600.

Regardless of the configuration of processing device 600, it may employ one or more memories or memory modules (including memory 606) configured to store program instructions to perform the methods disclosed herein. In some implementations, the program instructions may be configured to cause CPU 604 and/or processor 608 to perform operations for performing data gathering and calculations necessary to facilitate error cancelation for one or more magnetic sensor measurement(s), i.e., by applying error correction term(s) to magnetic sensor measurements as a function of current.

The various embodiments described above are provided by way of illustration only and should not be construed to limit the scope of the disclosure. For example, the principles herein apply equally to optimization as well as general improvements. Various modifications and changes may be made to the principles described herein without following the example embodiments and applications illustrated and described herein, and without departing from the spirit and scope of the disclosure. Claim language reciting "at least one of" a set indicates that one member of the set or multiple members of the set satisfy the claim.

Statements of the Disclosure

Statement 1: a computer-implemented method comprising: receiving a first orientation signal, wherein the first orientation signal comprises a magnetic field signal generated from measurements produced by a magnetometer disposed in a drilling tool chassis, receiving a second orientation signal, processing the magnetic field signal to generate a clean magnetic field signal, and calculating a residual signal based on the clean magnetic field signal and the second orientation signal.

Statement 2: the computer-implemented method of statement 1, wherein the second orientation signal comprises a gravitational field signal generated from measurements produced by one or more accelerometers in the drilling tool chassis.

Statement 3: the computer-implemented method of any of statements 1-2, wherein the second orientation signal is generated using one or more gyroscopic sensors.

Statement 4: the computer-implemented method of any of statements 1-3, wherein the magnetic field signal indicates an orientation of the drilling tool.

Statement 5: the computer-implemented method of any of statements 1-4, wherein a direction of maximum sensitivity indicated by the first orientation signal and a direction of maximum sensitivity indicated by the second orientation signal differ by a substantially constant offset.

Statement 6: the computer-implemented method of any of statements 1-5, wherein processing the magnetic field signal to generate the clean magnetic field signal further comprises: processing an x-component of the magnetic field signal to generate a clean x-component signal, and processing a y-component of the magnetic field signal to generate a clean y-component signal, and wherein the clean x-component signal and the clean y-component signal are orthogonal.

Statement 7: the computer-implemented method of any of statements 1-6, further comprising: identifying one or more harmonics in the residual signal.

Statement 8: a system comprising one or more processors, and a non-transitory computer-readable medium comprising instructions stored therein, which when executed by the processors, cause the processors to perform operations comprising receiving a first orientation signal, wherein the first orientation signal comprises a magnetic field signal generated from measurements produced by a magnetometer disposed in a drilling tool chassis, receiving a second orientation signal, processing the magnetic field signal to generate a clean magnetic field signal, and calculating a residual signal based on the clean magnetic field signal and the second orientation signal.

Statement 9: the system of statement 8, wherein the second orientation signal comprises a gravitational field signal generated from measurements produced by one or more accelerometers in the drilling tool chassis.

Statement 10: the system of any of statements 8-9, wherein the second orientation signal is generated using one or more gyroscopic sensors.

Statement 11: the system of any of statements 8-10, wherein the magnetic field signal indicates an orientation of the drilling tool.

Statement 12: the system of any of statements 8-11, wherein a direction of maximum sensitivity indicated by the first orientation signal and a direction of maximum sensitivity indicated by the second orientation signal differ by a substantially constant offset.

Statement 13: the system of any of statements 8-12, wherein processing the magnetic field signal to generate the clean magnetic field signal further comprises processing an x-component of the magnetic field signal to generate a clean x-component signal, and processing a y-component of the magnetic field signal to generate a clean y-component signal, and wherein the clean x-component signal and the clean y-component signal are orthogonal.

Statement 14: the system of any of statements 8-13, wherein the processors are further configured to perform operations comprising identifying one or more harmonics in the residual signal.

Statement 15: a non-transitory computer-readable storage medium comprising instructions stored therein, which when executed by one or more processors, cause the processors to perform operations comprising receiving a first orientation signal, wherein the first orientation signal comprises a magnetic field signal generated from measurements produced by a magnetometer disposed in a drilling tool chassis, receiving a second orientation signal, processing the magnetic field signal to generate a clean magnetic field signal, and calculating a residual signal based on the clean magnetic field signal and the second orientation signal.

Statement 16: the non-transitory computer-readable storage medium of statement 15, wherein the second orientation signal comprises a gravitational field signal generated from measurements produced by one or more accelerometers in the drilling tool chassis.

Statement 17: the non-transitory computer-readable storage medium of any of statements 15-16, wherein the second orientation signal is generated using one or more gyroscopic sensors.

Statement 18: the non-transitory computer-readable storage medium of any of statements 15-17, wherein the magnetic field signal indicates an orientation of the drilling tool.

Statement 19: the non-transitory computer-readable storage medium of any of statements 15-18, wherein a direction of maximum sensitivity indicated by the first orientation signal and a direction of maximum sensitivity indicated by the second orientation signal differ by a substantially constant offset.

Statement 20: the non-transitory computer-readable storage medium of any of statements 15-19, wherein processing the magnetic field signal to generate the clean magnetic field signal further comprises: processing an x-component of the magnetic field signal to generate a clean x-component signal, and processing a y-component of the magnetic field signal to generate a clean y-component signal, and wherein the clean x-component signal and the clean y-component signal are orthogonal.

Statement 21: a computer-implemented method comprising: receiving a residual signal, wherein the residual signal is based on one or more magnetic field signals and at least one gravitational field signal corresponding with a drilling tool orientation over time, analyzing the residual signal to identify one or more tool vibration harmonics, and identifying one or more drilling anomalies based on the one or more tool vibration harmonics.

Statement 22: the computer-implemented method of statement 21, wherein the one or more tool vibration harmonics are a function of tool angle.

Statement 23: the computer-implemented method of any of statements 21-22, further comprising: automatically adjusting one or more drilling operation parameters based on the one or more drilling anomalies.

Statement 24: the computer-implemented method of any of statements 21-23, wherein analyzing the residual signal further comprises: filtering the residual signal to remove one or more high-frequency components.

Statement 25: the computer-implemented method of any of statements 21-24, wherein the residual signal comprises motion data associated with rotation of the drilling tool.

Statement 26: the computer-implemented method of any of statements 21-25, wherein the one or more drilling anomalies is associated with a drill pad failure.

Statement 27: the computer-implemented method of any of statements 21-26, further comprising: determining a borehole diameter based on the residual signal.

Statement 28: a system comprising: one or more processors, and a non-transitory computer-readable medium comprising instructions stored therein, which when executed by the processors, cause the processors to perform operations comprising: receiving a residual signal, wherein the residual signal is based on one or more magnetic field signals and at least one gravitational field signal associated with a drilling tool orientation over time, analyzing the residual signal to identify one or more tool vibration harmonics, and identifying one or more drilling anomalies based on the one or more tool vibration harmonics.

Statement 29: the system of statement 28, wherein the one or more tool vibration harmonics are a function of tool angle position.

Statement 30: the system of any of statements 28-29, wherein the processors are further configured to perform operations comprising: automatically adjusting one or more drilling operation parameters based on the one or more drilling anomalies.

Statement 31: the system of any of statements claim 28-30, wherein analyzing the residual signal further comprises: filtering the residual signal to remove one or more high-frequency components.

Statement 32: the system of any of statements 28-31, wherein the residual signal comprises motion data associated with rotation of the drilling tool.

Statement 33: the system of any of statements 28-32, wherein the one or more drilling anomalies is associated with a drill pad failure.

Statement 34: the system of any of statements 28-33, wherein the processors are further configured to perform operations comprising: determining a borehole diameter based on the residual signal.

Statement 35: a non-transitory computer-readable storage medium comprising instructions stored therein, which when executed by one or more processors, cause the processors to perform operations comprising: receiving a residual signal, wherein the residual signal is based on one or more magnetic field signals and at least one gravitational field signal associated with a drilling tool orientation over time, analyzing the residual signal to identify one or more tool vibration harmonics, and identifying one or more drilling anomalies based on the one or more tool vibration harmonics.

Statement 36: the non-transitory computer-readable storage medium of statement 35, wherein the one or more tool vibration harmonics are a function of tool angle position.

Statement 37: the non-transitory computer-readable storage medium of any of statements 35-36, further comprising: automatically adjusting one or more drilling operation parameters based on the one or more drilling anomalies.

Statement 38: the non-transitory computer-readable storage medium of any of statements 35-37, wherein analyzing the residual signal further comprises: filtering the residual signal to remove one or more high-frequency components.

Statement 39: the non-transitory computer-readable storage medium of any of statements 35-38, wherein the residual signal comprises motion data associated with rotation of the drilling tool.

Statement 40: the non-transitory computer-readable storage medium of any of statements 35-39, wherein the one or more drilling anomalies is associated with a drill pad failure.

Statement 41: a computer-implemented method comprising: retrieving legacy drilling data from one or more databases, the legacy drilling data comprising orientation data for an associated drilling tool, calculating a residual signal based on the legacy drilling data, and training a machine-learning model based on the residual signal.

Statement 42: the computer-implemented method of statement 41, wherein the legacy drilling data comprises at least one magnetic field signal and at least one gravitational field signal.

Statement 43: the computer-implemented method of any of statements 41-42, wherein the legacy drilling data is associated with anomaly data indicating one or more anomalies detected during a drilling operation performed with the drilling tool.

Statement 44: the computer-implemented method of any of statements 41-43, wherein training the machine-learning model based on the residual signal further comprises: receiving anomaly data associated with the drilling tool, and providing the anomaly data to the machine-learning model for correlation with the residual signal.

Statement 45: the computer-implemented method of any of statements 41-44, wherein the machine-learning model is configured to perform anomaly detection.

Statement 46: the computer-implemented method of any of statements 41-45, wherein the legacy drilling data is associated with two or more geographic locations.

Statement 47: the computer-implemented method of any of statements 41-46, wherein the legacy drilling data is associated with two or more drilling tools.

Statement 48: a system comprising: one or more processors, and a non-transitory computer-readable medium comprising instructions stored therein, which when executed by the processors, cause the processors to perform operations comprising: retrieving legacy drilling data from one or more databases, the legacy drilling data comprising orientation data for an associated drilling tool, calculating a residual signal based on the legacy drilling data, and training a machine-learning model based on the residual signal.

Statement 49: the system of statement 48, wherein the legacy drilling data comprises at least one magnetic field signal and at least one gravitational field signal.

Statement 50: the system of any of statements 48-49, wherein the legacy drilling data is associated with anomaly data indicating one or more anomalies detected during a drilling operation performed with the drilling tool.

Statement 51: the system of any of statements 48-50, wherein training the machine-learning model based on the residual signal further comprises: receiving anomaly data associated with the drilling tool, and providing the anomaly data to the machine-learning model for correlation with the residual signal.

Statement 52: the system of any of statements 48-51, wherein the machine-learning model is configured to perform anomaly detection.

Statement 53: the system of any of statements 48-52, wherein the legacy drilling data is associated with two or more geographic locations.

Statement 54: the system of any of statements 48-53, wherein the legacy drilling data is associated with two or more drilling tools.

Statement 55: a non-transitory computer-readable storage medium comprising instructions stored therein, which when executed by one or more processors, cause the processors to perform operations comprising: retrieving legacy drilling data from one or more databases, the legacy drilling data comprising orientation data for an associated drilling tool, calculating a residual signal based on the legacy drilling data, and training a machine-learning model based on the residual signal.

Statement 56: the non-transitory computer-readable storage medium of statement 55, wherein the legacy drilling data comprises at least one magnetic field signal and at least one gravitational field signal.

Statement 57: the non-transitory computer-readable storage medium of any of statements 55-56, wherein the legacy drilling data is associated with anomaly data indicating one or more anomalies detected during a drilling operation performed with the drilling tool.

Statement 58: the non-transitory computer-readable storage medium of any of statements 55-57, wherein training the machine-learning model based on the residual signal further comprises: receiving anomaly data associated with the drilling tool, and providing the anomaly data to the machine-learning model for correlation with the residual signal.

Statement 59: the non-transitory computer-readable storage medium of any of statements 55-58, wherein the machine-learning model is configured to perform anomaly detection.

Statement 60: the non-transitory computer-readable storage medium of any of statements 55-59, wherein the legacy drilling data is associated with two or more geographic locations.

What is claimed is:

1. A computer-implemented method comprising:

receiving a first orientation signal, wherein the first orientation signal comprises a magnetic field signal generated from measurements produced by a magnetometer disposed in a drilling tool chassis;

receiving a second orientation signal;

processing the magnetic field signal to generate a clean magnetic field signal; and calculating a residual signal based on the clean magnetic field signal and the second orientation signal.

2. The computer-implemented method of claim 1, wherein the second orientation signal comprises a gravitational field signal generated from measurements produced by one or more accelerometers in the drilling tool chassis.

3. The computer-implemented method of claim 1, wherein the second orientation signal is generated using one or more gyroscopic sensors.

4. The computer-implemented method of claim 1, wherein the magnetic field signal indicates an orientation of the drilling tool.

5. The computer-implemented method of claim 1, wherein a direction of maximum sensitivity indicated by the first orientation signal and a direction of maximum sensitivity indicated by the second orientation signal differ by a substantially constant offset.

6. The computer-implemented method of claim 1, wherein processing the magnetic field signal to generate the clean magnetic field signal further comprises:

processing an x-component of the magnetic field signal to generate a clean x-component signal; and processing a y-component of the magnetic field signal to generate a clean y-component signal.

7. The computer-implemented method of claim 1, further comprising:

identifying one or more harmonics in the residual signal.

8. A system comprising:

one or more processors; and a non-transitory computer-readable medium comprising instructions stored therein, which when executed by the processors, cause the processors to perform operations comprising:

receiving a first orientation signal, wherein the first orientation signal comprises a magnetic field signal generated from measurements produced by a magnetometer disposed in a drilling tool chassis;

receiving a second orientation signal;

processing the magnetic field signal to generate a clean magnetic field signal; and calculating a residual signal based on the clean magnetic field signal and the second orientation signal.

9. The system of claim 8, wherein the second orientation signal comprises a gravitational field signal generated from measurements produced by one or more accelerometers in the drilling tool chassis.

10. The system of claim 8, wherein the second orientation signal is generated using one or more gyroscopic sensors.

11. The system of claim 8, wherein the magnetic field signal indicates an orientation of the drilling tool.

12. The system of claim 8, wherein a direction of maximum sensitivity indicated by the first orientation signal and a direction of maximum sensitivity indicated by the second orientation signal differ by a substantially constant offset.

13. The system of claim 8, wherein processing the magnetic field signal to generate the clean magnetic field signal further comprises:

processing an x-component of the magnetic field signal to generate a clean x-component signal; and processing a y-component of the magnetic field signal to generate a clean y-component signal.

14. The system of claim 8, wherein the processors are further configured to perform operations comprising:

identifying one or more harmonics in the residual signal.

15. A non-transitory computer-readable storage medium comprising instructions stored therein, which when executed by one or more processors, cause the processors to perform operations comprising:

receiving a first orientation signal, wherein the first orientation signal comprises a magnetic field signal generated from measurements produced by a magnetometer disposed in a drilling tool chassis;

receiving a second orientation signal;

processing the magnetic field signal to generate a clean magnetic field signal; and calculating a residual signal based on the clean magnetic field signal and the second orientation signal.

16. The non-transitory computer-readable storage medium of claim 15, wherein the second orientation signal comprises a gravitational field signal generated from measurements produced by one or more accelerometers in the drilling tool chassis.

17. The non-transitory computer-readable storage medium of claim 15, wherein the second orientation signal is generated using one or more gyroscopic sensors.

18. The non-transitory computer-readable storage medium of claim 15, wherein the magnetic field signal indicates an orientation of the drilling tool.

19. The non-transitory computer-readable storage medium of claim 15, wherein a direction of maximum sensitivity indicated by the first orientation signal and a direction of maximum sensitivity indicated by the second orientation signal differ by a substantially constant offset.

20. The non-transitory computer-readable storage medium of claim 15, wherein processing the magnetic field signal to generate the clean magnetic field signal further comprises:

processing an x-component of the magnetic field signal to generate a clean x-component signal; and processing a y-component of the magnetic field signal to generate a clean y-component signal.

* * * * *